United States Patent [19]

Wisneski

[11] 4,385,840

[45] May 31, 1983

[54] MIXING APPARATUS

[75] Inventor: Peter M. Wisneski, Houston, Tex.

[73] Assignee: Gulf Oil Corporation, Pittsburgh, Pa.

[21] Appl. No.: 268,957

[22] Filed: Jun. 1, 1981

Related U.S. Application Data

[63] Continuation-in-part of Ser. No. 239,815, Mar. 2, 1981, abandoned.

[51] Int. Cl.[3] ..... B01F 5/00; B01F 5/24

[52] U.S. Cl. ..... 366/336; 222/145; 366/341

[58] Field of Search ..... 366/32, 41, 9, 76, 77, 366/14, 15, 91, 154, 177, 181, 192, 193, 336–340, 341, 348, 349; 222/145, 564; 414/267, 268

[56] References Cited

U.S. PATENT DOCUMENTS 2,455,572 12/1948 Evans ..... 366/336
3,414,164 12/1968 McKay ..... 222/145
3,423,076 1/1969 Jacobs et al. ..... 366/337
4,260,739 4/1981 Geyer, Jr. et al. ..... 366/91 X

*Primary Examiner*—Philip R. Coe
*Assistant Examiner*—Timothy F. Simone
*Attorney, Agent, or Firm*—Deane E. Keith; Forrest D. Stine; Richard L. Kelly

[57] ABSTRACT

Apparatus is provided for blending batches of particulate material that are compositionally heterogeneous into batches of material that are compositionally uniform. The apparatus consists of two vertically aligned cylindrical mixers, including means to transfer product from the first mixer to the second mixer. Each mixer contains six or more vertically aligned partition walls that extend radially from the midpoint of the mixer to the wall to divide the mixer into at least six storage compartments of substantially equal volumetric capacity. The vertical partition walls differ in height in a regular descending order so that as material is charged to and fills one compartment, it overflows the shorter wall to fill the adjacent compartment.

10 Claims, 6 Drawing Figures

Fig. 1
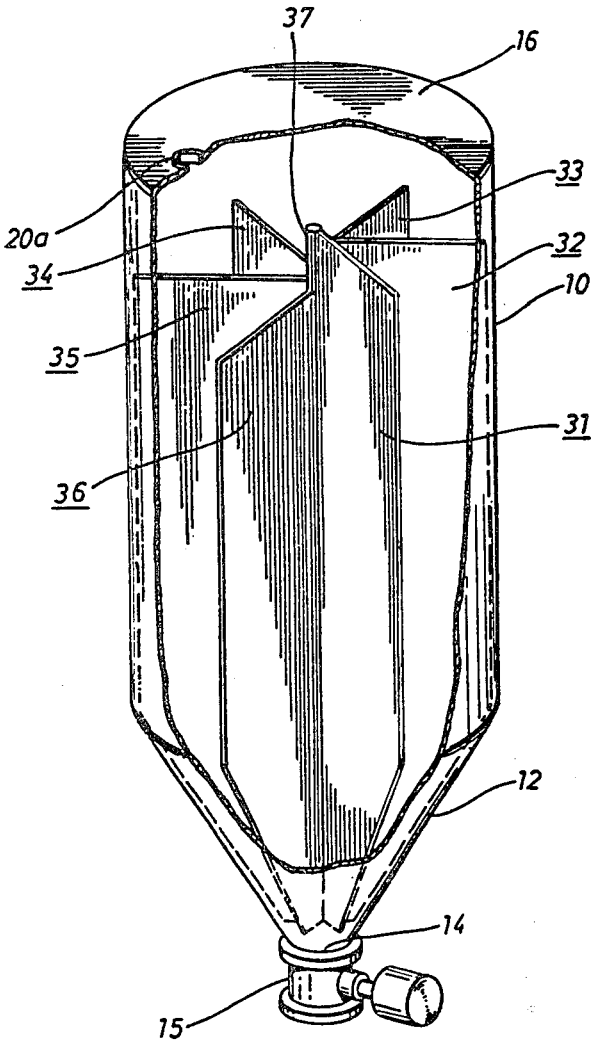
Fig. 2
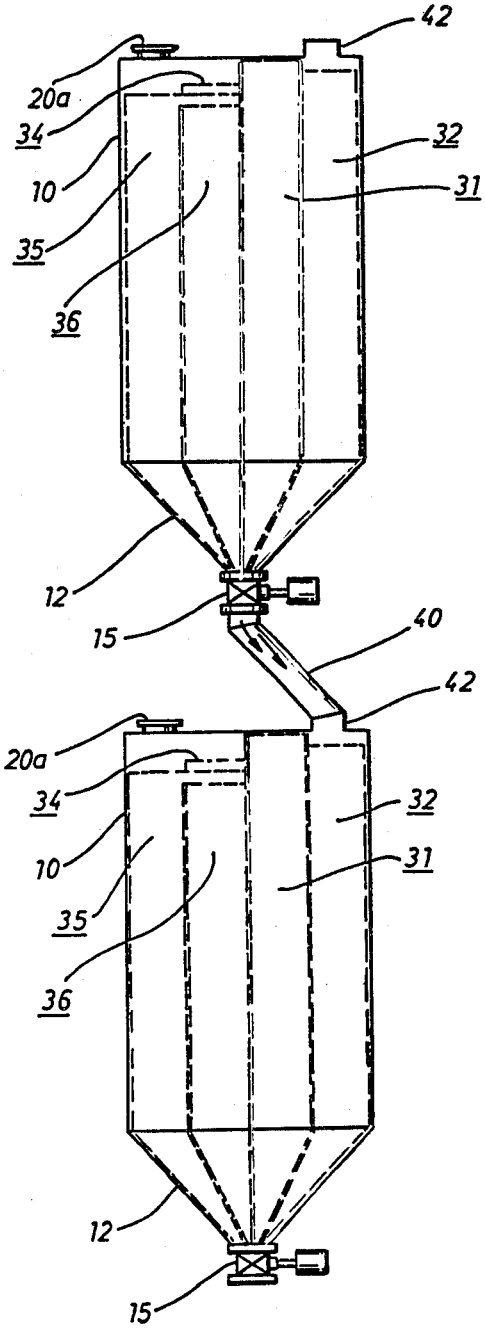
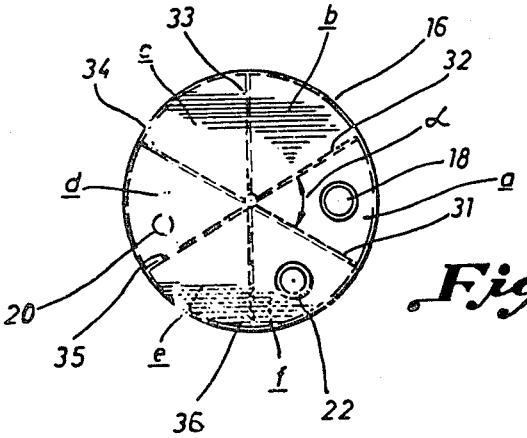
Fig. 3

MIXING APPARATUS

REFERENCE TO RELATED APPLICATION

This application is a continuation-in-part of copending application Ser. No. 239,815, filed on Mar. 2, 1981, now abandoned.

BACKGROUND OF THE INVENTION

In the manufacture of particulate materials such as thermoplastic polymers, e.g., high pressure polyethylene, it is observed that certain lots will have a desired property such as melt index which falls outside of product specifications. To provide a maximum percentage of product falling within product specifications, the manufacturer will blend a product lot having an undesirably high melt index with a product lot having an undesirably low melt index. The resulting mixed lot will have a melt index within specifications. Such lots customarily are mixed in rotary mixers and/or remelted and extruded. Such reprocessing entails high labor costs and, in addition, high energy costs when an extrusion step is employed.

In incorporating additives such as slip agents, antiblock agents, and the like into such resins, it is customary to first prepare dry blends of the resin and additive(s) and then extrude the dry blend to form the homogeneous mixture into pellets. Such processes are burdened with high labor and energy costs.

SUMMARY OF THE INVENTION

The present invention provides apparatus for blending batches of particulate material that are compositionally heterogeneous into batches of material that are compositionally uniform. The apparatus consists of two or more vertically aligned cylindrical mixers having a conduit to transfer product from the first mixer to the second mixer. Each mixer contains six or more vertically aligned partition walls that extend radially from the midpoint of the mixer to the wall to divide the mixer into at least six storage compartments of substantially equal volumetric capacity. The vertical partition walls differ in height in a regular descending order so that as material is charged to and fills one compartment, it overflows the shorter wall to fill the adjacent compartment.

BRIEF DESCRIPTION OF THE DRAWINGS

FIG. 1 is a perspective view of a single mixer with parts broken away.

FIG. 2 is a perspective view of two mixers in vertical alignment, including a conduit for feeding material from the top mixer to the bottom mixer.

FIG. 3 is a top plain view of the mixer shown in FIG. 1.

DETAILED DESCRIPTION OF THE INVENTION

Figure 4:
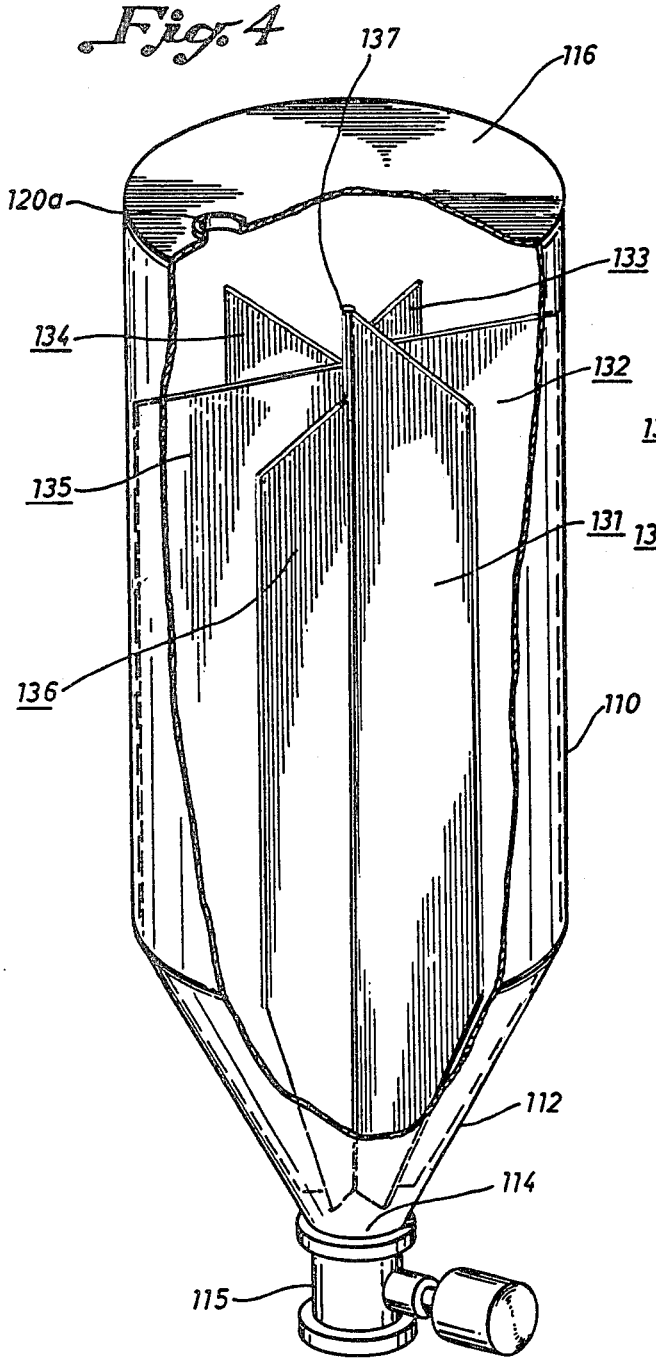
FIG. 4 is a perspective view of a second embodiment of a mixer with parts broken away.

As seen in FIG. 1, the mixer has a principal section 10 of cylindrical shape which terminates in a bottom section 12 of conical shape to provide ready gravity flow of particles from the discharge port 14 of the mixer. A gate valve 15 is provided to discharge the contents from the mixer. The top 16 of the mixer is provided with a product entry port 18, a vent port 20, and an access port 22 to provide entry into the mixer to make inspections and/or repairs. Suitable threaded covers **18*a*, 20*a*, and 22*a* are provided to seal ports 18, 30, and 22 when the mixer is not in use. The covers 20*a* and 22*a* preferably have a transparent section for visual inspection to determine the level of the contents in various sections of the mixer. The interior of the mixer is provided with a series of 6 vertical partition walls 31, 32, 33, 34, 35, and 36. The vertical interior edge of each partition wall fits tightly into channels provided in a centrally positioned vertical rod-like member 37. The partition walls extend radially from member 37 and fit tightly against the inner wall of the mixer to subdivide the mixer into a series of 6 pie-shaped compartments a, b, c, d, e, and f. The cross sectional area of each compartment is fixed by the angle $\alpha$ defined by its 2 partition walls; these angles being defined as, respectively, $\alpha$ (31, 32) for compartment a, $\alpha$ (32, 33) for compartment b, and so forth. In the embodiment shown, each of the $\alpha$ angles is the same and is 60°. The bottoms of each partition wall 31, 32, 33, 34, 35, and 36 are cut to lie in a common plane (normal to the plane of gravity) which is positioned as close as practical to the discharge port 14. This construction prevents any significant upward flow from any filled compartment into any unfilled compartment. In addition, this construction assures that the particles from each compartment will be discharged at a substantially uniform volumetric rate when valve 15** is opened.

In the embodiment illustrated in FIG. 1, the shape of each of partition wall 31 through 36 is identical except that each differs in height from the others. The order of the heights is such that 31>32>33>34>35>36. The partition walls are actually higher than shown in FIG. 1. They are shown in reduced height so that the differences in height are seen more easily in the perspective view shown. The effective depth, and thus the volumetric capacity, of each compartment a, b, c, d, e, and f is controlled by the height of its shorter wall. As the angles $\alpha$ are the same for each compartment, the respective volumetric capacity of the compartments is a>b>c>d>e>f. To provide a mixer in which each compartment has an equal volumetric capacity, the partition walls should be arranged so that $\alpha$(36, 31)>$\alpha$(35, 36)>$\alpha$(34, 35)>$\alpha$(33, 34)>$\alpha$(32, 33)>$\alpha$(31, 32). The precise differences in the sizes of angles will be dependent upon the respective heights of the partition walls and can be readily calculated by those skilled in the art.

The apparatus of the invention shown in FIG. 2 consists of two mixers in vertical alignment. The mixers are arranged so that a conduit 40 feeds particles discharged from the top mixer into the bottom mixer. The two mixers are identical in size and construction.

The entry port 18 of each mixer is arranged so that particulate matter charged to the mixer from a fill tube 42 flows directly into compartment a. When compartment a is filled, additional material charged to the mixer overflows partition wall 32 and falls into compartment b. As the filling action is continued, particulate matter successively and sequentially overflows partition walls 33, 34, 35, and 36 to fill compartments c, d, e, and f. The respective heights of partition walls 31, 32, 33, 34, 35, and 36 will be fixed to assure that the compartments of the mixer are filled in this order. In particular, the partition wall 31 will extend to the top of the mixer to prevent any overflow of material from compartment a into compartment f. The entry port 18 of the bottom mixer also is positioned so that the particles discharged from the top mixer through conduit 40 and fill tube 42 flow directly into compartment a and successively fill compartments a, b, c, d, e, and f, as previously described.

Figure 6:
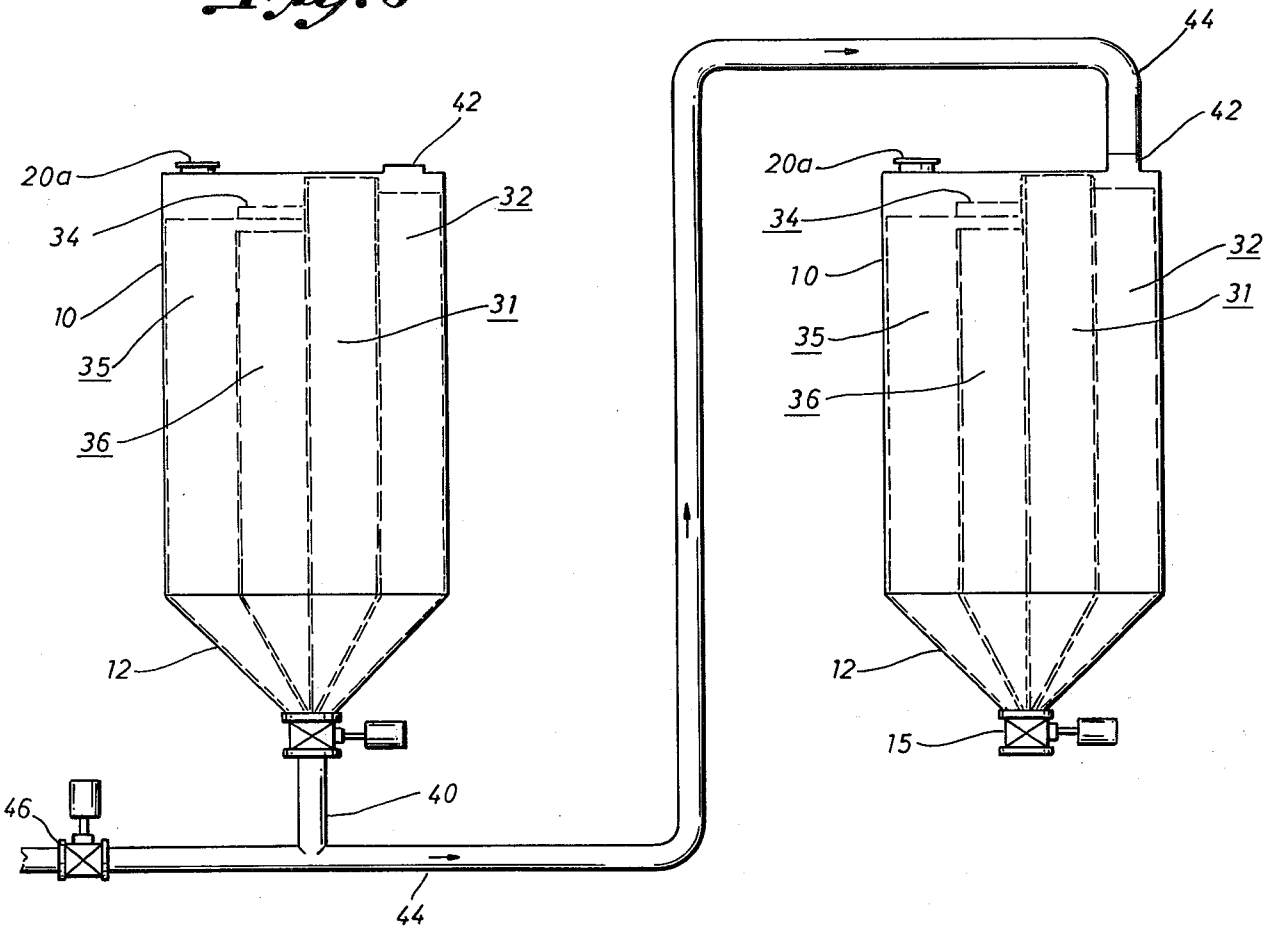
FIG. 6 is a perspective view of two mixers in horizontal alignment, including means for feeding material from the first mixer to the second mixer.

The apparatus shown in FIG. 6 is similar to that shown in FIG. 2, except that the two mixers are positioned in horizontal alignment rather than in vertical alignment. The construction of the mixers and their operation are essentially similar to that shown in FIG. 2, except for the means included to transfer particulate matter from the first mixer to the second mixer. The product discharged from the first mixer into conduit 40 flows into a transfer line 44. Air admitted into line 44 through valve 46 blows the discharged particulate matter from the first mixer through line 44 into the second mixer. In lieu of employing a simple gate valve in the first mixer, it is desirable to employ a rotary feeder valve to provide a positive discharge of product when air pressure is applied to line 44.

Figure 5:
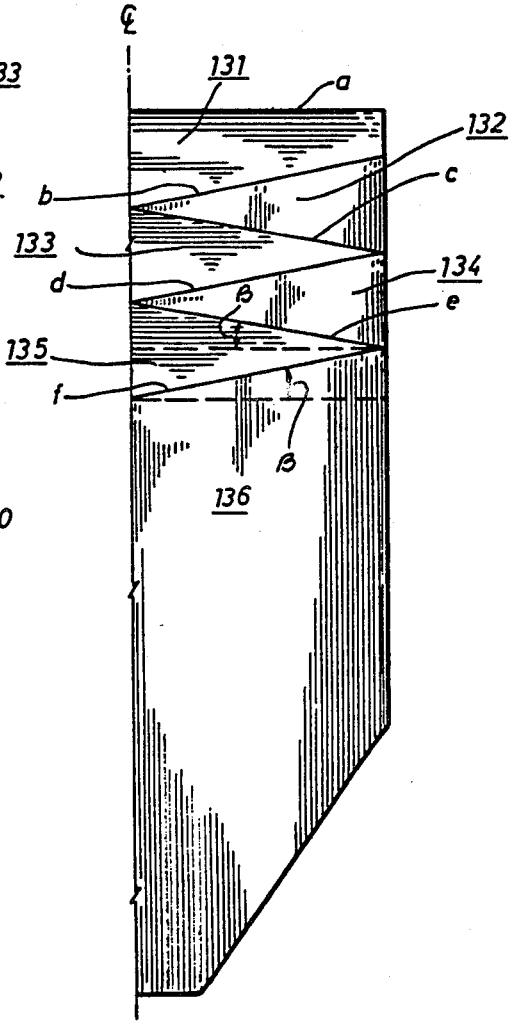
FIG. 5 shows a profile that the vertical partitions included in FIG. 4 would present if they were rotated counterclockwise.

FIG. 4 illustrates a modification of the mixer of FIG. 1 in which like parts bear identifying numbers 100 units higher than the corresponding parts shown in FIG. 1. Partition wall 131 has the same shape as corresponding wall 31 shown in FIG. 1 and extends to the top of the mixer. The top edge of each of the other partition walls 132, 133, 134, 135, and 136 is cut so that it either slopes from its midsection (i.e., the section that fits in member 137) to its wall section (i.e., the section that touches the inner mixer wall) or from its wall section to its midsection. The top edges of partition walls 133 and 135 slope from their midsections to their wall sections. The top surfaces of partition walls 132, 134, and 136 slope in the opposite direction, i.e., from their wall sections to their midsections. Normal lines drawn from the point at which partition walls 133 and 135 touch the inner mixer wall to rod member 137 define angles B. Similarly, normal lines drawn from the point at which the partition walls 132, 134, and 136 touch rod member 137 to the inner mixer wall define acute angles B. Typically, angles B are approximately 15°. If the partition walls were rotated counterclockwise, the top surfaces of the partition walls would show the cascading profile shown in FIG. 5. This construction provides easier overflow of particles from one compartment to the next compartment.

While the drawings illustrate mixers having 6 partition walls which divide the interior of the mixer into 6 compartments of substantially equal volumetric capacity, it is feasible to provide 7 or more partition walls to divide the mixer into 7 or more compartments. It has been the inventor's experience that 6 compartment mixers provide adequate mixing for most purposes when 2 mixers are employed. Where mixing of extremely heterogeneous materials is required, somewhat improved results are obtained when a third mixer is included in the apparatus of the invention.

The specific heights of the partition walls in the mixers will be somewhat dependent upon the flow characteristics of the materials to be blended in the mixers. The flow characteristics of particulate materials are proportional to their angles of repose. For many materials, such angles are known and reported in the literature. When such angles are not known, they can be readily determined by known methods. The required differentials in height between adjacent partition walls will be directly proportional to the angles of repose of the materials to be blended. The highest of the partition walls should extend to the top of the mixer. This will prevent any flow of charged material to the last of the concentrically arranged storage compartments. Each of the remaining partition walls should have its height reduced by the amount required to provide ready overflow from one filled storage compartment to the adjacent unfilled compartment.

The embodiment of FIG. 2 shows the two mixers in direct vertical alignment. The arrangement has a minimum space requirement, but requires that the transfer conduit 40 to be positioned at an angle from the field of gravity. When adequate space is available, the lower mixer can be offset somewhat from the first mixer to provide a direct drop from the discharge port of the top mixer to the entry port of the bottom mixer.

To provide optimum mixing efficiency in use, each of the mixers should be completely emptied before the material to be blended is charged thereto. The volume of each batch of particulate material to be used should be, to the extent practical, precisely equal to the volumetric storage capacity of the several storage compartments.* It will be recognized that some free space will remain above each of the storage compartments. If the batch to be blended is larger than the storage capacity of the several compartments, the excess particulate material will occupy a portion of the designed free space provided in the mixer. As the content of each of the individual storage compartments is discharged at the same rate, any excess material initially occupying the designed free space will not be mixed with any of the material stored in the storage compartments.

*In subsequent discussions, the total capacity of the several compartments will be referred to as the mixer's "effective capacity."

In situations where undersized batches of material require blending, the batch size should be selected to completely fill 2, 3, or more compartments of the mixers. Such undersized batches, in a single pass through the apparatus, will not be as well blended as full size batches. If a more homogeneous blend is required, such undersized batches should be passed through the apparatus two or more times.

Where it is desired to prepare a blend from 2 or more batches of particulate material, the precise order in which the batches are charged to the top mixer ordinarily is not critical. It is preferred, however, to charge each batch to the mixer in sequence. By operating in this manner, each batch will be concentrated in one or more compartments in the top mixer. When the contents are discharged from the top mixer, it will be well blended with the contents of the other compartments. The same mixing action takes place in the lower mixer(s) and it is readily seen that the final lot of material discharged from the bottommost mixer will be homogeneously blended.

The apparatus is well suited to prepare blends of an additive with particulate polymer at low cost. A typical blend that can be prepared is polyethylene containing a slip agent such as erucamide. In an initial step, the erucamide will be dispersed in polyethylene pellets at a concentration significantly higher than desired in the resin to be delivered to the customer. For purposes of illustration only, the additive concentration will be six times the concentration desired in the final product. This concentrate will be prepared by any desired method as by compounding in an extruder. A lot of this polymer concentrate having a volume equivalent to one-sixth of the mixer's effective capacity will be charged to the top mixer. When employing the apparatus illustrated in FIGS. 1 and 2, the concentrate will completely fill compartment a. A second lot of the polymer containing no erucamide, having a volume equivalent to five-sixths of the mixer's effective capacity then will be charged to the top mixer. The additive-free resin will completely fill compartments b, c, d, e, and f. When valve 15 of the top mixer is opened, the contents of each compartment a, b, c, d, e, and f are discharged at essentially equivalent volumetric rates. Thus the particles flowing through conduit 40 into the second mixer will contain, on an average, equal volumes of particles from each compartment of the top mixer.

As the particles from the top mixer flow into the second mixer, each compartment will be filled with a mixture containing, on a volume basis, one part of the concentrate and five parts of the additive-free polymer. Any deviations from the desired 1:5 ratio will be small. When the final blend is discharged from the bottom mixer, the uniformity of the blend will be further enhanced. The final product will contain 1 particle of concentrate for each 5 particles of additive-free polymer. When this product is extruded by the ultimate user, the melt mixing in the extruder will provide film having the erucamide sufficiently well distributed throughout the film to be suitable for nearly all purposes.

In preparing a mixture of polymer products, a manufacturer frequently is faced with the problem of preparing a series of related polymers containing two additives, one of which is common to the entire family of products and the second of which is specific for the individual polymer products. A typical series of polymer products of this type are film grade polymers containing a slip agent such as erucamide and a specific colorant for each polymer product. To prepare such a series of polymer products, a first polymer master batch containing erucamide will be prepared as previously described. A master batch also will be prepared for each polymer product and will contain the colorant at a concentration substantially six times the concentration desired in the finished product. The top mixer will be first charged with one of the master batches and then the second master batch. This charging order will fill compartment a with one master batch and compartment b with the second master batch. The mixer then is filled with uncompounded or additive-free polymer. When the valve 15 of the top mixer is open, the contents of each compartment a, b, c, d, e, and f are discharged at essentially equivalent volumetric rates. The particles flowing through conduit 40 into the second mixer will contain, on an average, one volume part of the first master batch, one volume part of the second master batch, and four volume parts of the uncompounded or additive-free polymer.

As noted from the above descriptions, in preparing batches of polymer particles having additives mixed therewith, the first essential step is to prepare a polymer master batch of the desired additive(s) at a concentration such that the master batch will be included in the final batch in a volumetric proportion such that the master batch will fill one or an even number of compartments of the top mixer. The master batch containing the additive should be charged to the first mixer in such a manner as to be contained entirely within one or an even number of the compartments of the mixer. This is done most conveniently by charging the master batch to the mixer prior to charging the uncompounded or additive-free polymer to the mixer.

Another application of the apparatus of the invention is to increase the homogeneity of a batch of polymer particles which for any reason are more heterogeneous in composition than desired. Again, in the manufacture of polyethylene by high pressure autoclave process, it is sometimes noted that undesirably wide fluctuations of melt index are present in the product exiting the reactor. By passing such batches of polymer through the apparatus of the invention, the various segments of the initial batch become blended so that the entire batch of polymer discharged from the bottommost mixer is more homogeneous with respect to melt index.

What is claimed:

1. Apparatus for blending flowable particles consisting essentially of:

A. A first vertically aligned mixer of essentially cylindrical shape including;
  (1) a principal section that is essentially cylindrical in shape,
  (2) a bottom section of conical shape to provide ready gravity flow of particles from the mixer,
  (3) a centrally positioned discharge port in the bottom of the mixer,
  (4) a valve in said discharge port,
  (5) a series of at least six vertical partition walls within the mixer, each of which extends radially from the midpoint of the mixer to the mixer wall to divide the mixer into at least six storage compartments, each of which differs in height from each of the others, said vertical partition walls being further characterized in that;
    (a) the partition walls are positioned in regular descending order of height about the midpoint of the mixer so that each wall other than the highest wall is higher than one adjacent wall and lower than the other adjacent wall,
    (b) the angles formed between each adjacent pair of partition walls being substantially equal so that each storage compartment has substantially an equal volumetric capacity,
    (c) the differences in height of the partition walls are such that as each storage compartment is filled with particles, additional particles added to the top of said compartment readily overflow into the adjacent compartment, and
    (d) the bottom of each partition wall extends to within inches of the discharge port, the bottom construction of the partition walls being such that particles flow by gravity at substantially equal volumetric rates from each compartment when the valve of the discharge port is opened,
  (6) an inlet port in the top of the mixer and positioned so that particles fed therethrough flow by gravity directly into the compartment defined by the first and second highest vertical partition walls, B. A second vertically aligned mixer, the volumetric capacity and construction of said second mixer being essentially identical to said first mixer, and C. Means for feeding flowable particles from the discharge port of the first mixer to the inlet port of the second mixer.

2. Apparatus of claim 1 in which:

A. The top surface of the second highest partition wall slopes from its midsection to its wall section, B. The top surface of the third highest partition wall slopes from its wall section to its midsection, and C. The top surfaces of each successively lower partition wall slope either from the midsection to the wall section, or from the wall section to the midsection with the direction of slope of each partition wall being opposite the direction of slope of the adjacent higher partition wall.

3. Apparatus of claim 1 or 2 in which the two mixers are of identical size and construction and are positioned in vertical alignment so that product discharged from the top mixer flows by gravity into the second mixer.

4. Apparatus of claim 1 or 2 in which the mixers are positioned in horizontal alignment.

5. A method for preparing a batch of polymer particles having an additive substantially uniformly distributed therethrough, which consists essentially of:

A. Blending said additive with an aliquot of the batch of polymer particles,

B. Sequentially charging, in any order, the aliquot of step (A) and the balance of the batch of said polymer particles to a first empty mixer characterized in having;

(1) a principal section of generally cylindrical shape fitted with a conically shaped bottom section to provide ready gravity flow of particles from said mixer, (2) a centrally positioned discharge port in the bottom of the mixer, (3) a valve in said discharge port, (4) a series of at least six vertical partition walls within the mixer, each of which extends radially from the midpoint of the mixer to the mixer wall and divides the mixer into at least six storage compartments of substantially equal volumetric capacity, each of which differs in height from each of the others, said partition walls being further characterized in that;

(a) the partition walls are positioned in regular descending order of height about the midpoint of the mixer so that each wall other than the highest wall is higher than one adjacent wall and lower than the other adjacent wall, (b) the differences in height of the partition walls are such that as each storage compartment is filled with particles, additional particles added to the top of said compartment readily overflow into the adjacent compartment, and (c) the bottom of each partition wall extends to within inches of the discharge port, the bottom construction of the partition walls being such that particles flow by gravity at substantially equal volumetric rates from each compartment when the valve of the discharge port is opened, (5) an inlet port in the top of the mixer and positioned so that particles fed therethrough flow directly by gravity into the compartment defined by the first and second highest vertical partition walls, C. Discharging the entire contents of said first mixer through its discharge port and feeding said discharged material into the inlet port of a second mixer; the volumetric capacity and construction of said second mixer being substantially identical to that of said first mixer, and D. Discharging the entire contents of said second mixer and recovering a batch of polymer particles having said additive substantially uniformly distributed throughout said batch;

said process further characterized that the volumetric size of said batch of polymer particles and additive is such that it completely fills each storage compartment of said mixers.

6. A process for increasing the homogeneity of a batch of particulate material which is heterogeneous in composition, which consists essentially of:

A. Charging the entire batch of particulate material to a first empty mixer characterized in having;

(1) a principal section of generally cylindrical shape fitted with a conically shaped bottom section to provide ready gravity flow of particles from said mixer, (2) a centrally positioned discharge port in the bottom of the mixer, (3) a valve in said discharge port, (4) a series of at least six vertical partition walls within the mixer, each of which extends radially from the midpoint of the mixer to the mixer wall and divides the mixer into at least six storage compartments of substantially equal volumetric capacity, each of which differs in height from each of the others, said partition walls being further characterized in that;

(a) the partition walls are positioned in regular descending order of height about the midpoint of the mixer so that each wall other than the highest wall is higher than one adjacent wall and lower than the other adjacent wall, (b) the differences in height of the partition walls are such that as each storage compartment is filled with particles, additional particles added to the top of said compartment readily overflow into the adjacent compartment, and (c) the bottom of each partition wall extends to within inches of the discharge port, the bottom construction of the partition wall being such that particles flow by gravity at substantially equal volumetric rates from each compartment when the valve of the discharge port is opened, (5) an inlet port in the top of the mixer and positioned so that particles fed therethrough flow directly by gravity into the compartment defined by the first and second highest vertical partition walls, B. Discharging the entire contents of said first mixer through its discharge port and feeding said discharged material into the inlet port of a second mixer; the volumetric capacity and construction of said mixer being substantially identical to that of said first mixer, and C. Discharging the entire contents of said second mixer and recovering a batch of particulate material of substantially uniform composition;

said process further characterized in that the volumetric size of said batch of particulate material is such that it completely fills each storage compartment of said mixers.

7. A process of claim 5 or 6 in which (1) the contents of the second mixer are discharged into a third mixer, the volumetric capacity and construction of said third mixer being essentially identical to said first two mixers, and (2) recovering the product from the discharge port of said third mixer.

8. A process of claim 5 in which the aliquot having the additive blended therewith is charged to the first mixer before the balance of said batch of polymer particles is charged thereto.

9. A process of claim 6 in which the particulate material is polymer particles.

10. Apparatus for blending flowable particles consisting essentially of a plurality of vertically aligned mixers interconnected in series so that material fed to the first mixer flows through each mixer before being discharged from the last mixer of said series; each of said mixers being essentially cylindrical in shape and including:

(1) a principal section that is essentially cylindrical in shape, (2) a bottom section of conical shape to provide ready gravity flow of particles from the mixer, (3) a centrally positioned discharge port in the bottom of the mixer, (4) a valve in said discharge port, (5) a series of at least six vertical partition walls within the mixer, each of which extends radially from the midpoint of the mixer to the mixer wall to divide the mixer into at least six storage compartments, each of which differs in height from each of the others, said vertical partition walls being further characterized in that;

(a) the partition walls are positioned in regular descending order of height about the midpoint of the mixer so that each wall other than the highest wall is higher than one adjacent wall and lower than the other adjacent wall, (b) the angles formed between each adjacent pair of partition walls are substantially equal so that each storage compartment has substantially an equal volumetric capacity, (c) the differences in height of the partition walls are such that as each storage compartment is filled with particles, additional particles added to the top of said compartment readily overflow into the adjacent compartment, and (d) the bottom of each partition wall extends to within inches of the discharge port, the bottom construction of the partition walls being such that particles flow by gravity at substantially equal volumetric rates from each compartment when the valve of the discharge port is opened, and (6) an inlet port in the top of the mixer and positioned so that particles fed therethrough flow by gravity directly into the compartment defined by the first and second highest vertical partition walls.

* * * * *